US005236222A

United States Patent [19]

Fletcher

[11] Patent Number: 5,236,222

[45] Date of Patent: Aug. 17, 1993

[54] ROLLER SKATE POLE DEVICE

[76] Inventor: Thomas G. Fletcher, 2161 S. Downing, Denver, Colo. 80210

[21] Appl. No.: 899,760

[22] Filed: Jun. 17, 1992

[51] Int. Cl.[5] ..... A63C 3/00

[52] U.S. Cl. ..... 280/809; 280/826; 188/5; 135/77; 135/86

[58] Field of Search ..... 280/1129, 809, 812, 280/816, 819, 820, 821, 823, 826; 188/5; 135/77, 79, 82, 84, 86

[56] References Cited

U.S. PATENT DOCUMENTS

| | | | |
|---|---|---|---|
| D. 262,646 | 1/1982 | Mace | 280/819 X |
| 1,340,616 | 5/1920 | Lynde | 135/86 |
| 1,985,726 | 12/1934 | Heldman | 280/826 |
| 2,253,012 | 8/1941 | Benner et al. | 280/11.19 X |
| 3,368,811 | 2/1968 | Finney | 280/821 X |
| 3,712,652 | 1/1973 | Uilkema | 280/823 X |
| 3,866,931 | 2/1975 | Marker | 280/820 |
| 4,288,102 | 9/1981 | Ramer | 280/821 X |
| 4,756,524 | 7/1988 | Cooney | 135/84 X |
| 4,811,750 | 3/1989 | McAllister | 135/84 X |
| 5,056,819 | 10/1991 | Hayes | 280/820 X |

FOREIGN PATENT DOCUMENTS

| | | | |
|---|---|---|---|
| 3508347 | 9/1986 | Fed. Rep. of Germany | 135/77 |
| 2470621 | 6/1981 | France | 280/821 |
| 73736 | 11/1916 | Switzerland | 135/77 |
| 429535 | 7/1967 | Switzerland | 280/820 |
| 4073 | of 1888 | United Kingdom | 135/86 |
| 121841 | 1/1919 | United Kingdom | 135/86 |

*Primary Examiner*—Brian Johnson

*Attorney, Agent, or Firm*—Timothy J. Martin; Dana S. Rewoldt

[57] ABSTRACT

A skate pole device can be used alone or in pairs by a roller skater in order to advance or retard movement along a skate surface. The skate pole has an elongated shaft with a handle portion on one end and a foot portion on the other end. First and second pads are mounted in the foot portion. The first pad is constructed of a type adapted to frictionally grip the skate surface so that the skater may exert a thrusting motion with the skate pole, and this material may be a stiff, yet resilient, rubber-like substance such as a soft thermoplastic. The second pad is constructed of a different type of material, such as a hard thermoplastic, that is adapted to act as a brake pad against the skate surface so that the skater may apply a drag force. A pair of such skate poles may be used and, if desired, interconnecting elements are provided to releasably secure two such skate poles alongside one another.

20 Claims, 3 Drawing Sheets

ROLLER SKATE POLE DEVICE

FIELD OF INVENTION

The present invention generally relates to roller skating apparatus used for the recreational sport of roller skating, roller blading and the like. Specifically, the present invention concerns a skate pole which may be used by a skater to control his/her speed both as a braking device and as a thrusting device.

BACKGROUND OF THE INVENTION

Roller skating has long been enjoyed both as a sport and a recreational activity. Whether enjoyed in an indoor or outdoor environment, this activity employs special skates in the form of shoes adapted to be worn on the feet, with these shoes being provided with a plurality of wheels so that the skater may roll across a skate surface. Thus, a skater utilizing proper foot work may travel across the skate surface.

For a long time, traditional roller skates each had two pairs of metal rollers, a first pair located in opposed relation at the toe end of the skate and a second pair located in opposed relation at the rear of the skate. For many years, very little changed in the technology of the roller skate, and the popularity of roller skating stagnated. However, in relatively recent times, the popularity of roller skating has dramatically increased due to two advances in technology. First, metal wheels were replaced by high-impact plastic urethane wheels that were wider in profile and that provided greater contact friction with the skate surface. Second, manufacturers began to produce roller skates wherein a plurality of wheels were located longitudinally "in-line" rather than in opposed pairs. These in-line skates, commonly referred to as "roller blades" now command a significant share of the roller skating market. Further, due to the more versatile nature of roller blades provided with urethane wheels, roller skating has gone from an activity typically practiced in a confined area, such as a skating rink or local concrete or asphalt surface to a more far ranging activity wherein the skates serve as a means of transportation or distance exercise.

When roller skating was practiced in a confined area, the skate surface was normally a flat surface, but now a skater often ventures over wider terrain and is likely to encounter different surface grades. Thus, skaters now find themselves confronted with sloping surfaces that must either be ascend, descended or traversed. Where a skater is faced with an upwardly sloping skate surface, greater effort is necessary to advance therealong. Where a skater is faced with a downwardly sloping surface, there is a danger of losing control resulting in excessive speed and risk of injury. In order to help control excessive speeds on downhill grades, some roller skaters have recently resorted to use of a drag pole, usually home-made, in the form of a shaft provided with a rubber end caps at one end. When a skater gains excessive speed, the rubber stopper may be dragged to act as a brake. This rather crude pole lacks the ability to provide different contact pads for both propelling and braking; further, the soft rubber end caps are subjected to extensive wear.

The use of pole-like devices to control movement is, of course, not new. For many years, the snow skiers have employed ski poles as auxiliary equipment to aid in controlling motion. These ski poles are used to help propel the skier on upward slopes, as an aid in turning, as balancing devices and, in limited instances, maybe dragged in order to help brake the skier's motion. To serve these functions, a typical ski pole includes an elongated shaft having a handle at one end and a spike and basket assembly at an opposite end. In use, a skier presses the spiked end into a snow surface until the basket bears against the surface thereby allowing the skier to exert a force thereon. Of course, the use of ski poles on a skating surface would be impractical since a skate surface is ordinarily constructed of a relatively impenetrable material, such as asphalt, concrete, hardwood, etc.

Even though the sport and recreation of roller skating has been in existence for decades, there has not heretofore been developed a suitable skate pole which can be used by a skater in controlling his/her movement or which can act as an aid in balancing during a skating activity. Therefore, there has been a long felt need for this skate pole provided by the present invention, whether such a pole is used alone or whether a pair of such poles are used. There has been a further need for a skate pole which can be used as an aid in propelling a skater along uphill inclines, which can assist a skater in balancing and which can retard the motion of a skater when descending a downwardly sloping skate surface.

SUMMARY OF THE INVENTION

It is an object of the present invention to provided a new and useful skate pole which may be employed by a skater to both advance and retard movement along a skate surface.

A further object of the present invention is to provide a skate pole which may be used alone or in pairs as an aid in balancing a skater and for controlling movement along a skate surface.

Still a further object of the present invention is to provide a skate pole device which is relatively inexpensive in manufacturer and which is light weight and convenient to carry during a skating activity.

Yet another object of the present invention is to provide a skate pole device that has alternative contact elements for making contact with a skate surface with one contact element being adapted to act as a brake against the surface while another acting as a gripping element to allow a skater to exert a thrusting force on the skate surface.

It is a still further object of the present invention to provide a skate pole device which has a pair of contact elements which are easily replaceable when worn out.

According to the present invention, then, a skate pole device is provided for use by a skater when skating on a skate surface. The skate pole device according to the present invention may be used alone or in pairs so that the skater may apply a thrusting force to the skate surface in order to advance movement therealong or so that the skater may apply a drag or brake force to the skate surface in order to retard movement therealong. In the broad form of the present invention, this skate pole device is formed as an elongated shaft which has a handle portion at a first end and a foot portion at a second end opposite the first end. First and second pads are secured to the foot portion, and each has an exposed pad portion. The first pad portion is formed of a first material selected of a type that is adapted to frictionally grip the skate surface whereby the skater may engage the skate surface and manipulate the skate pole to apply a thrusting force. The second pad has an exposed second pad portion formed of a second material different from the first selected material and being of a type adapted to act as a brake pad against the skate surface whereby the skater may engage the skate surface with the second pad portion thereby to apply a frictional drag force to the skate surface in order to act as a brake to retard movement therealong.

The shaft of the skate pole may desirably be formed as a plurality of telescoping sections so that it may be extended and collapsed between an operative and stored states. Suitable latches are provided in such configuration to releasably retain the telescoping sections in the operative state. The foot portion of the ski pole device may be formed integrally with the shaft or with a shaft section but may alternatively and preferably be an independent element mountable in the shaft. In either event, the foot portion is constructed as an open housing with a surrounding sidewall that forms an open cavity sized to operatively receive and support the first and second pads so that the first and second exposed pad portions protrude therefrom. The first material used for the first pad may be a stiff, yet resilient, rubber-like substance, and it is preferred to form the first pad entirely of this material. Likewise, it is preferred to form the entire second pad out of the second material which in turn is a hard, rubber-like substance. The first and second pads are configured to nest together in close-fitted relationship within the cavity so that they support one another during use. Releasable mounting elements, such as screws or other securing means are provided to releasably retain each of the first and second pads in the cavity of the foot portion.

In one exemplary form of the present invention, it is contemplated that a pair of skate pole devices be used. In this embodiment, the pair of skate pole devices are provided with cooperative interconnecting structure to releasably interconnect the skate poles so that their respective shafts are alongside one another with the foot portions being in side-by-side, adjacent relation. This interconnection accordingly places the first pads of each skate pole device side-by-side and also places the second pads of each skate pole device side-by-side. The interconnecting structure may be a slotted bracket on one foot portion and a head structure on the other foot portion with the head portion being operative to matably engage the slotted bracket. The slotted bracket and head structures may be formed on the foot portions. If desired, a second pair of cooperative engagement elements may be located proximately to the handle portions of the pole device and may be conveniently hook and loop fastening strips.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention relates to pole devices which may be used by a skater during roller skating activities both to apply a thrusting force to the skate surface in order to advance movement therealong and to apply a drag force to this skate surface in order to retard movement therealong. As used herein, the phrase "roller skating" includes both traditional roller skating wherein the roller skates have opposed wheels and to roller blading wherein the roller skates have in-line rollers. Furthermore, it should be appreciated that the skate pole device according to the present invention may be used either alone or in pairs during a roller skating activity.

Figure 1:
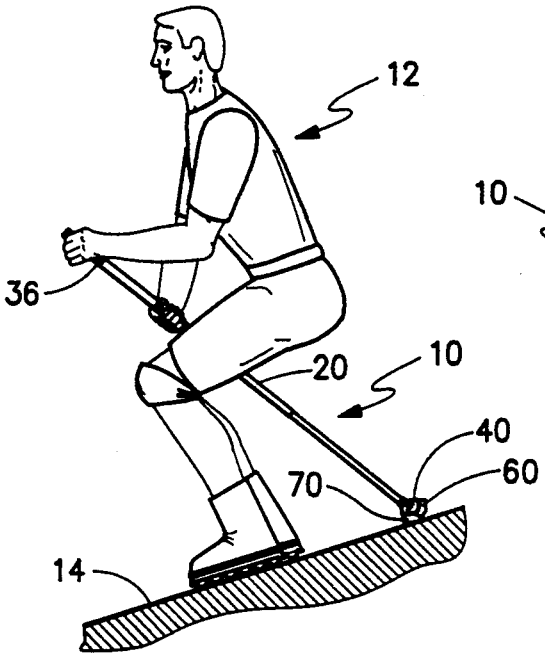
FIG. 1 is a perspective view showing a skater utilizing the skate pole device according to the present invention to apply a braking force to a skate surface.

As is shown in FIG. 1, a skate pole device 10 according to a first exemplary embodiment of the present invention may be used by a skater 12 to apply a force to a skating surface 14. In FIG. 1, skater 12 is applying a drag or braking force to the skate surface, which is shown as downwardly sloping incline. Skate pole device 10 includes an elongated shaft 20 which has a primary handle portion 36 located at a first end so that skater 12 may manually grasp the handle portion. A foot portion 40 is located at a second end opposite handle portion 36 and, as is shown in FIG. 1, has a pad assembly defined by a pair of pads 60 and 70 which may be used to engage the skate surface 14.

Figure 2:
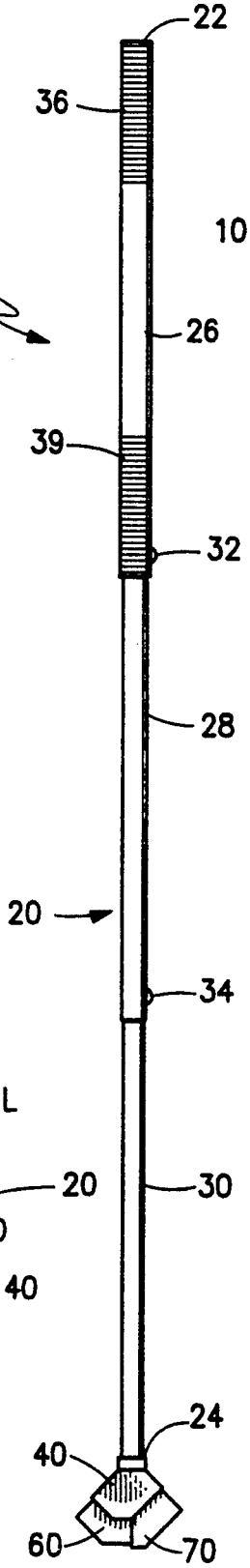
FIG. 2 is a side view in elevation showing an exemplary embodiment of the skate pole device according to the present invention in an extended state.
Figure 3:
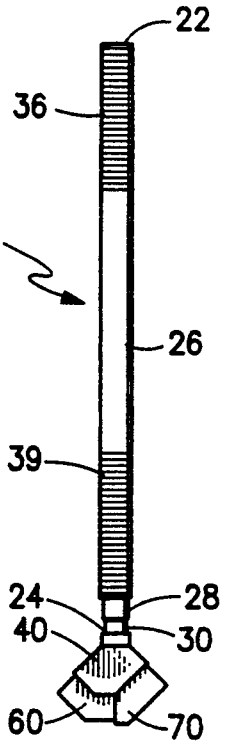
FIG. 3 is a side view in elevation showing the skate pole device of FIG. 2 in a collapsed state.

The exemplary skate pole device 10 is shown in FIG. 2 in an extended state and in FIG. 3 a collapsed state. Here, it should be appreciated that skate pole device 10 may be formed of a plurality of telescoping sections 26, 28 and 30 which may be telescoped together into the collapsed state in or extended into the operative state. When extended, sections 26, 28 and 30 may be latched into the operative state, for example, by means of button latches 32 and 34, of a type known in the art. Telescoping sections 26, 28 and 30 are preferably formed of light weight, tubular material, such as aluminum or plastic.

As was noted above, a first end 22 of elongated shaft 20 is provided with a primary handle portion 36 which may be formed by wrapping an end portion thereof with suitable gripping tape 38; primary handle portion 36 may also be formed, coated or provided with such other gripping material as is well-known in the art. Handle portion 36 may be configured or contoured as desired to facilitate manual gripping. An auxiliary handle portion 39 may be provided, for example on section 26, at a longitudinally spaced location from handle portion 36. Therefore, the skater may grip the ski pole device 10 with his/her hands located at longitudinally spaced locations thereon, as is shown in FIG. 1.

Figure 4:
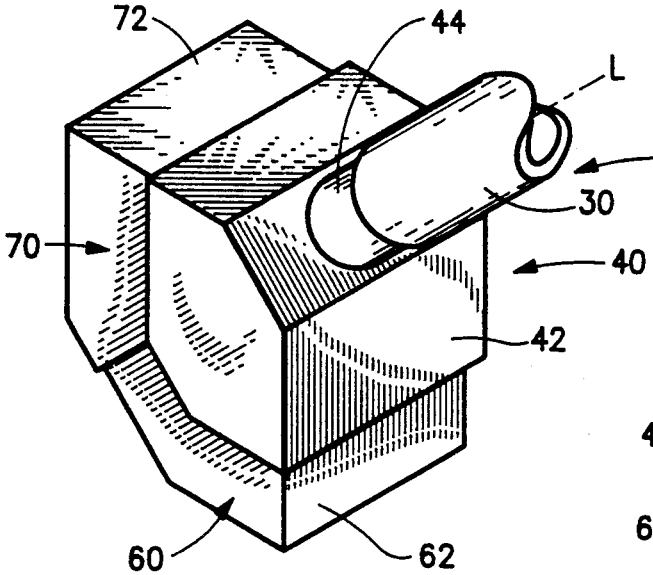
FIG. 4 is an enlarged perspective view of the foot portion of the skate pole device shown in FIGS. 2 and 3.
Figure 6:
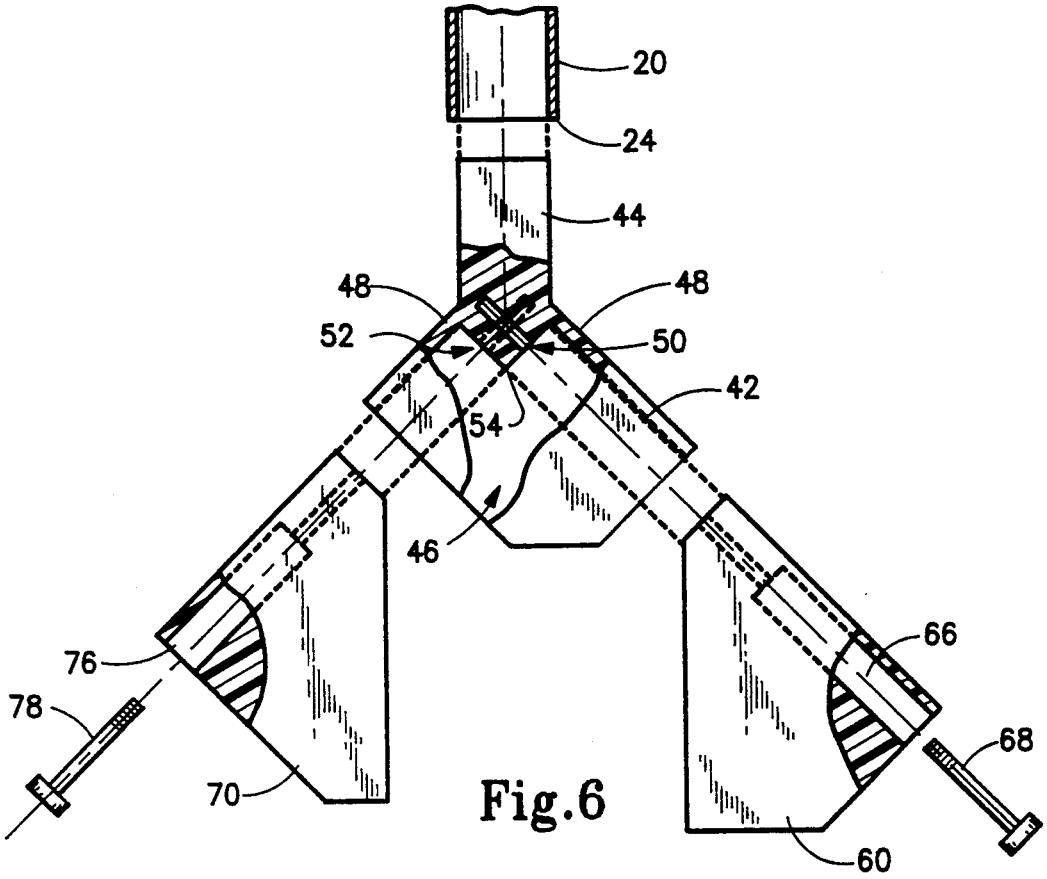
FIG. 6 is an exploded side view in elevation and in partial cross-section showing the foot portion of FIGS. 4 and 5.
Figure 5:
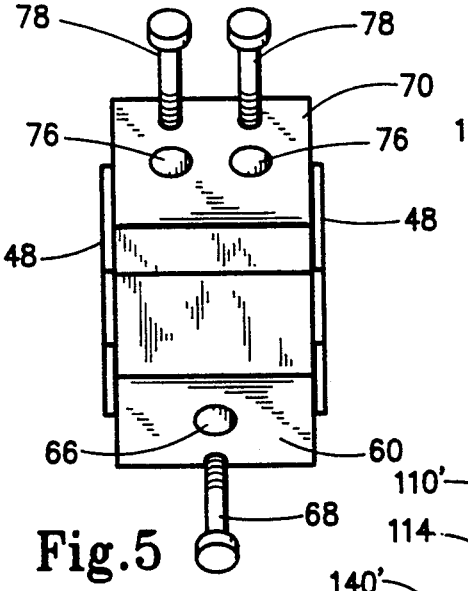
FIG. 5 is a bottom plan view of the foot portion shown in FIG. 4 with the fastening screws being removed therefrom.

Foot portion 40 and its associated pads 60 and 70 are best shown in FIGS. 4–6 where it may be seen that foot portion 40 is formed as an independent molded element that may be mounted at first end 24 to extend longitudinally of longitudinal axis "L" of shaft 20. Foot portion 40 includes a housing 42 from which extends a shank 44 that is sized to be matably inserted into second end 24 of shaft 20 as is shown in FIGS. 4 and 6. This mounting may be a press-fit, or a suitable adhesive or other fastening means may be provided to secure shank 44 at end 24 of shaft 20. Foot portion 40 is preferably an integral one-piece molded high-impact plastic construction and is formed so that housing 42 has a hollow interior defining a cavity 46 bounded by a surrounding sidewall 48. Pads 60 and 70 are sized and configured to matably nest in cavity 46 so that they have exposed pad portions 62 and 72, respectively, as is best shown in FIG. 4.

As noted above, first pad 60 is preferably formed of a first material selected of a type that is adapted to frictionally grip the skate surface whereby the skater may engage the skate surface with first pad portion 62 in order to apply a thrusting force. To this end, the first material used for constructing pad portion 62 is preferably a stiff, yet resilient, rubber-like substance, such as a soft natural or synthetic rubber or soft thermoplastic material, such as vinyl or elastomeric. Furthermore, although it would be possible to construct only the exposed portion 62 of pad portion 60 of this material, it is preferred that pad portion 60 be entirely constructed as a unitary piece of the first material.

Pad 70 has an exposed pad portion 72 which is formed of a second material different from the first material. Here, the second material used for exposed pad portion 72 is a hard rubber-like substance such as a relatively hard theremoplastic or rubber material, such as vulcanized rubber, such as used for automobile tires, and the like. Again, while it would be possible to construct only pad portion 72 of this material, it is preferred to construct pad 70 as a single piece of such material such that exposed pad portion 72 is provided by that part of pad 70 which protrudes from cavity 46. Pad portion 72 is adapted to be forced against skate surface 14 so that it frictionally drags against surface 14 thereby acting as a brake against movement of the skater.

From the above, it should be appreciated that both pad 70, to a large extent, and pad 60, to a lesser extent, may become worn during use and require replacement by the skater. Accordingly, each of pads 60 and 70 are preferred to be releasably retained within cavity 46 by any convenient fastening means. One such example of a simple and inexpensive technique is to provide pad portion 60 with a countersunk bore 66 adapted to receive a screw 68 which is threadably received in a threaded bore 50 formed into base 54 of shank 44 located interiorly of cavity 46. Likewise, pad 70 may be provided with a pair of countersunk bores 76 which receive a pair of screws 78 which are threadably received in threaded bores 52 and base 54. As may be seen in reference to FIGS. 5 and 6, threaded bores 50 and 52 are spaced from one another so that they do not intersect within base 54.

From the above description, it should be now understood that pad 60 and 70 nest within cavity 46 so that exposed pad portions protrude therefrom to contact the skate surface. The first and second pads are configured to nest together in close-fitted relationship so that first and second pads 60 and 70 act, along with sidewall 48, to support one another within cavity 46. In use, a skater may employ skate pole device 10 for auxiliary propulsion and for braking action. In order to provide a thrusting force, the skater poles against skate surface 14 by engaging skate surface 14 with pad portion 62 of first pad 60 which acts to frictionally grip the surface so that the skater may shove skate pole device 10 against the surface thereby pushing himself/herself therealong. Alternatively, where a skater has excessive speed, he/she may rotate skate pole device 10 a half-turn (i.e., 180°) and apply a dragging force against skate surface 14 by pressing exposed portion 72 of second pad 70 against skate surface 14. Accordingly, exposed portion 72 acts as a brake pad to retard the movement of the skater along the support surface.

Figure 7:
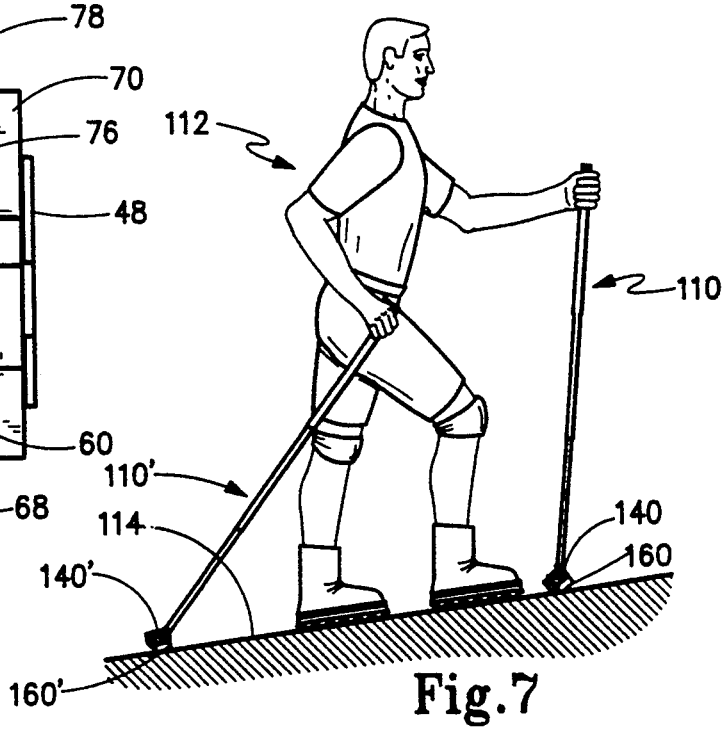
FIG. 7 is a side view in elevation showing a skater ascending an incline using a pair of skate poles to provide a thrusting force to the skate surface.
Figure 8:
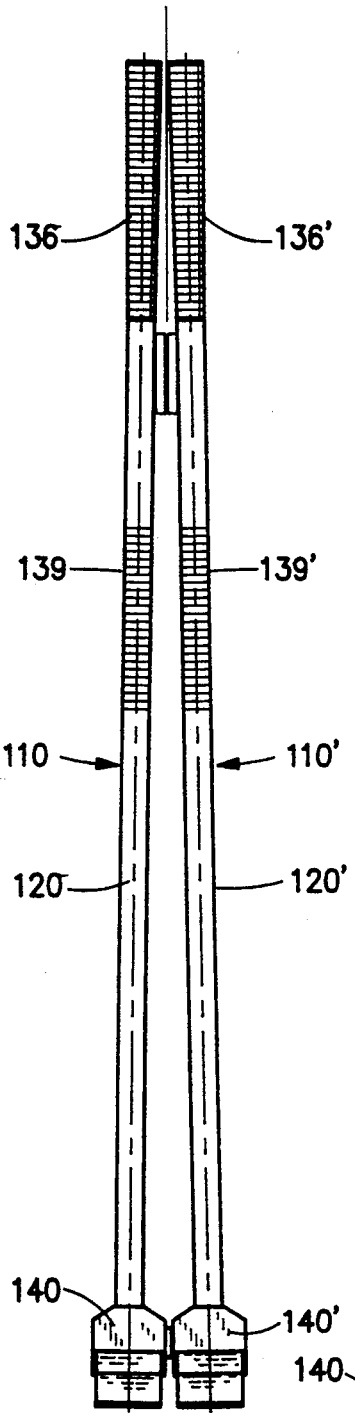
FIG. 8 is a front view in elevation showing a pair of interconnectable ski poles according to another exemplary embodiment of the present invention.

While it is possible to employ a single skate pole device 10 during a roller skating activity, it is often more convenient to provide a pair of skate poles for the skater, much in the manner of ski poles. This allows the skater to hold a skate pole device in each hand for balance, bracing or for polling against the skate surface. As is shown in FIG. 7, skater 112 is using a pair of skate pole devices 110 and 110' to pole or advance up an inclined skate surface 114. To this end, and as should now be readily appreciated by one skilled in the art with reference to the present disclosure, the skater 112 contacts skate surface 114 with first pads 160, 160' located in foot portions 140, 140' in order to exert a thrusting force thereon by means of the gripping actin of pads 160, 160'. Accordingly, as is shown in FIGS. 8–11, the pair of skate pole devices 110 and 110' are provided and are constructed substantially identically with the exception of their interconnecting elements, as described more thoroughly below. In these figures, skate pole devices 110, 110' have elongated shafts 120, 120' which are here formed of a singular tube of material rather than in telescoping sections. Each of ski pole devices 110, 110' have primary handle portions 136, 136' and auxiliary handle portions 139, 139'. Furthermore, each is provided with foot portions 140, 140' which respectively receive first pads 160, 160' and second pads 170, 170' of a type discussed with respect to the embodiments of FIGS. 1–6.

As is shown in FIGS. 8–11, ski pole devices 110, 110' are adapted to interconnect alongside one another so that pad portions 160, 160' and 170, 170' are respectively placed in side-by-side relation. This interconnection is desired when a skater desires to employ ski pole devices 110, 110' as braking mode. To facilitate this interconnection, a first pair of interconnecting elements is provided respectively on foot portions 140, 140', and a second pair of interconnecting elements are provided on shafts 120, 120', proximately to handle portions 136, 136'.

Figure 11:
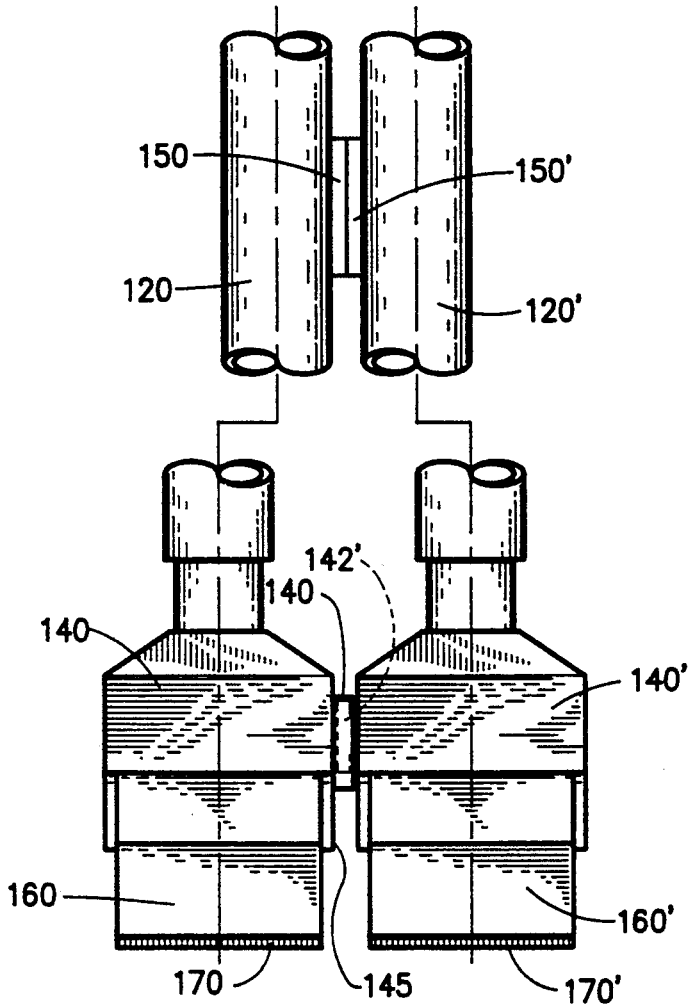
FIG. 11 is an enlarged view showing the interconnecting elements for the skate pole pair of FIG. 8.
Figure 9:
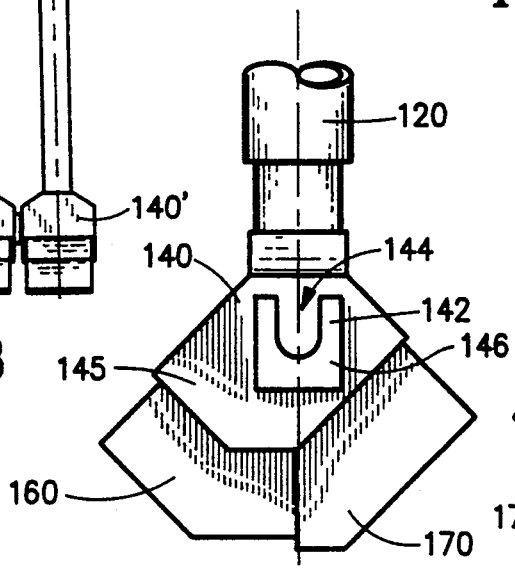
FIG. 9 is a side view in elevation of the foot portion of a first skate pole of the pair shown in FIG. 8.
Figure 10:
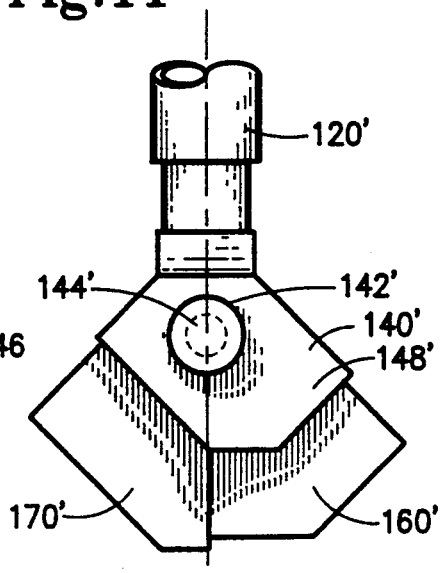
FIG. 10 is a side view in elevation of the foot portion of a second skate pole pair shown in FIG. 8.

With reference to FIGS. 9–11, it may be seen that foot portion 140 is provided with a slotted bracket 142 having a slot 144 formed in a outer wall 146 spaced from surface 145. Foot portion 140' is provided with a head structure 142' adapted to be matably received within slotted bracket 142. Head structure 142, is mounted in spaced relation to surface 148, of foot portion 140' on post 144' shown (in phantom) in FIG. 10. Post 144' is sized to slidably fit within slot 144 so that head structure 142' may be retained in bracket 142, as is shown in FIG. 10.

A second pair of cooperative engagement elements are located on shafts 120, 120', proximately to handle portions 136, 136'. Here, the second pair of cooperative engagement elements are preferably hook and loop fastening strips 150, 150', of common construction. Thus, for example, fastening strip 150 may be formed as a threaded loop construction while fastening strip 150' may be formed as fill-a-form or hook elements. Strips 150, 150' may be secured to shafts 120, 120' by any suitable means, such as an adhesive.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A skate pole device adapted to be used by a skater when skating on a skate surface so that the skater may apply a thrusting force to the skate surface in order to advance movement therealong and so that the skater may apply a drag force to the skate surface in order to retard movement therealong, comprising:

(a) an elongated shaft having a primary handle portion at a first end thereof and a foot portion at a second end opposite said first end; and (b) a pad assembly secured to said foot portion and including a first pad and a second pad disposed laterally with respect to one another, said first paid having an exposed first pad portion formed of a first material selected of a type that is adapted to frictionally grip the skate surface whereby the skater may engage the skate surface with the first pad portion and apply a thrusting force with respect thereto, said second pad having an exposed second pad portion formed of a second material different from said first selected material and selected of a type adapted to act as a brake paid against the skate surface whereby the skater may engage the skate surface with the second pad portion and apply a drag force in order to control movement therealong, said first and second pad portions arranged for selective independent engagement with said skate surface,

2. A skate pole device according to claim 1 wherein said shaft is formed of a plurality of telescoping sections whereby said shaft may be collapsed into a stored state yet extended into an operative state, and including latch means for latching said telescoping sections into the operative state.

3. A skate pole device according to claim 1 including an auxiliary handle portion on said shaft and spaced longitudinally of said primary handle portion.

4. A skate pole device according to claim 1 wherein said first material is a stiff yet resilient rubber-like substance.

5. A skate pole device according to claim 4 wherein said second material is a hard rubber-like substance.

6. A skate pole device according to claim 1 wherein said first pad is constructed entirely of the first material and wherein said second pad is constructed entirely of the second material.

7. A skate pole device according to claim 1 including means for releasably securing said first and second pads to said foot portion.

8. A skate pole device according to claim 1 wherein said foot portion is formed as a separate foot piece adapted to be mounted at the second end of said shaft.

9. A skate pole device adapted to be used by a skater when skating on a skate surface so that the skater may apply a thrusting force to the skate surface in order to advance movement therealong and so that the skater may apply a drag force to the skate surface in order to retard movement therealong, comprising:

(a) an elongated shaft having a primary handle portion at a first end thereof and a foot portion at a second end opposite said first end, said foot portion formed as an open housing having a cavity with a surrounding sidewall;

(b) a first pad mountably received and supported in said cavity and having an exposed first pad portion protruding from said housing, said first pad portion formed of a first material selected of a type that is adapted to frictionally grip the skate surface whereby the skater may engage the skate surface with the first pad portion and apply a thrusting force with respect thereto; and (c) a second pad mountably received and supported in said cavity and having an exposed second pad portion protruding from said housing, said second pad portion formed of a second material different from said first selected material and selected of a type adapted to act as a brake pad against the skate surface whereby the skater may engage the skate surface with the second pad portion and apply a drag force in order to control movement therealong.

10. A skate pole device according to claim 9 wherein said first and second pads are configured to nest together in close-fitted relationship within the cavity of said foot portion whereby said first and second pads support one another therein.

11. Speed control apparatus adapted to be used by a skater when skating on a skate surface so that the skater may apply a thrusting force to the skate surface in order to advance movement therealong and so that the skater may apply a drag force to the skate surface in order to retard movement therealong, comprising first and second skate pole devices each having an elongated skate with a handle portion at a first end thereof and a foot portion at a second end thereof opposite said first end, a first pad secured to said foot portion and having an exposed first pad portion, and a second pad secured to said foot portion and having an exposed second pad portion, said first pad and said second pad disposed laterally with respect to one another, said first and second pad portions arranged for selective independent engagement with said skate surface, each said first pad portion formed of a first material selected of a type that is adapted to frictionally grip the skate surface whereby the skater may engage the skate surface with the first pad portion and apply a thrusting force with respect thereto and each said second pad portion formed of a second material different from said first selected material and selected of a type adapted to act as a brake pad against the skate surface whereby the skater may engage the skate surface with the second pad portion and apply a drag force in order to control movement therealong.

12. Speed control apparatus according to claim 11 including interconnect means for releasably interconnecting said first and second pole devices alongside one another.

13. Speed control apparatus according to claim 12 wherein said interconnect means includes a first pair of cooperative engagement elements located on the foot portions of said pole devices.

14. Speed control apparatus according to claim 13 wherein said first pair of cooperative engagement elements includes a slotted bracket structure on one of said foot portions and a head structure on another of said foot portions, said head structure operative to matably engage said slotted bracket structure to interconnect said foot portions to one another.

15. Speed control apparatus according to claim 13 wherein said interconnect means includes a second pair of cooperative engagement elements, each of said cooperative engagement elements located on said shaft proximately to the handle portions of each of said pole devices.

16. Speed control apparatus according to claim 15 wherein said second pair of cooperative engagement elements are defined by a pair of hook and loops fastening strips.

17. Speed control apparatus according to claim 11 wherein the shaft of each said pole device is formed of a plurality of telescoping sections whereby each said shaft may be collapsed into a stored state yet extended into an operative state.

18. A speed control apparatus according to claim 11 wherein said first material is a stiff yet resilient rubber-like substance and wherein said second material is a hard rubber-like substance.

19. A speed control apparatus according to claim 11 wherein each said foot portion is formed as an open housing having a cavity with a surrounding sidewall, said cavity operative to mountably receive and support said first and second pads therein with said first and second exposed pad portions protruding therefrom.

20. A speed control apparatus according to claim 19 wherein said first and second pads are configured to nest together in close-fitted relationship within the cavity of a respective foot portion whereby said first and second pads support one another therein.

* * * * *